US005439401A

United States Patent [19]

Clark

[11] Patent Number: 5,439,401

[45] Date of Patent: Aug. 8, 1995

[54] ELECTRIC TROLLING MOTOR STEERING DEVICE

[76] Inventor: James F. Clark, 11146 Circle Loop, King George, Va. 22485

[21] Appl. No.: 300,789

[22] Filed: Sep. 2, 1994

[51] Int. Cl.[6] ..... B63H 5/12

[52] U.S. Cl. ..... 440/6; 440/60

[58] Field of Search ..... 440/6, 58, 59, 60, 63; 114/144 R, 162

[56] References Cited

U.S. PATENT DOCUMENTS

| | | | |
|---|---|---|---|
| 1,118,930 | 12/1914 | Hallongren | 440/60 |
| 2,960,057 | 11/1960 | Taylor . | |
| 3,989,000 | 11/1976 | Foley, Jr. . | |
| 4,151,807 | 5/1979 | Black, Jr. | 114/153 |
| 4,386,918 | 6/1983 | Matthews et al. | 440/7 |
| 4,698,032 | 10/1987 | Hill | 440/58 |
| 4,735,166 | 4/1988 | Dimalanta | 440/58 |
| 5,046,974 | 9/1991 | Griffin, Jr. et al. | 440/63 |

*Primary Examiner*—Jesus D. Sótelo
*Attorney, Agent, or Firm*—Raymond L. Greene

[57] ABSTRACT

A two-position geared steering device for an electric trolling motor is provided. The steering device has a tiller attached to a sector drive gear. The sector drive is rotatably mounted by a bracket on a fixed part of the electric trolling motor engaging the two-part split shaft gear which is clamped to the motor shaft. The electric trolling motor steering device provides steering with rotation of the tiller in either a vertical or horizontal plane. The sector drive gear assembly allows repositioning the sector and the tiller to operate in either the horizontal and vertical planes. The steering device may be easily adapted to an existing trolling motor using a simple clamp assembly.

11 Claims, 10 Drawing Sheets

ELECTRIC TROLLING MOTOR STEERING DEVICE

FIELD OF THE INVENTION

The invention is related to the electric trolling motor technology field and in particular to geared steering devices for electric trolling motors.

BACKGROUND OF THE INVENTION

Auxiliary steering devices for use on small boat trolling motors are well-known in the art. A variety of handle and foot-activated tillers have been designed. Among these designs are clamp-on non-geared tillers and geared tillers. The geared tillers allow complete rotation of the trolling motor while the tiller moves through a shorter arc, e.g. a 60° arc.

Typically, the electric trolling motor must be positioned away from the primary outboard motor on a fishing craft to allow proper steering movement of the trolling motor without causing interference with the primary outboard. This interference can be caused by the necessary rotation of a tiller using a 1:1 steering ratio. To overcome this problem, several prior art devices are available having a geared tiller mechanism wherein the tiller moves through a shorter arc while the trolling motor completes a full 360° rotation (e.g. tiller moves through a 180° arc). Nevertheless, the typical horizontal movement of the tiller means that interference or awkward operation occurs for installations on some boats. Other alternatives provided in the prior art include units using foot control pedals connected via cable to the trolling motor. Depending on the design of the floor of the boat, foot pedals may also be unsuited to certain boats.

In summary, the shortcomings of the prior art devices include the requirement to rotate the tiller through a complete 360° arc to provide full circle steering, the requirement to have a clear arc horizontal for moving the tiller (even in geared systems) and the lack of a means of adapting the tiller to a desired configuration for different boats.

SUMMARY OF THE INVENTION

It is an object of this invention to provide an electric trolling motor steering device which turns the trolling motor shaft 360° in response to a tiller handle movement to an arc of 50° to 70°.

It is another object of the invention to provide an electric trolling motor steering device which provides steering with rotation of the tiller in either a vertical or horizontal plane.

It is yet another object of the invention to provide an electric trolling motor steering device which can be quickly and easily changed from the horizontal tiller position to the vertical tiller position.

It is still another object of the invention to provide an electric trolling motor steering device which may be clamped to existing trolling motors with little modification to the trolling motor.

Accordingly, the invention is a two-position geared tiller device for attachment to existing trolling motors. In a preferred embodiment, the device comprises a shaft gear which attaches to the trolling motor shaft, a sector drive gear which engages the shaft gear, and a tiller handle engaging the sector drive gear. The unique design of the sector shaft gear allows repositioning the sector or the tiller to allow operation in both the horizontal and vertical planes. A detachable bracket allows the tiller-sector drive gear combination to be repositioned to provide four different combinations: sector drive gear horizontal, tiller operating horizontally; sector drive gear horizontal, tiller operating vertically; sector drive gear vertical, tiller operating horizontally; sector drive gear vertical, tiller operating vertically. As a result of these features, the steering device may be easily adapted to an existing trolling motor to provide vertical or horizontal tiller movement.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
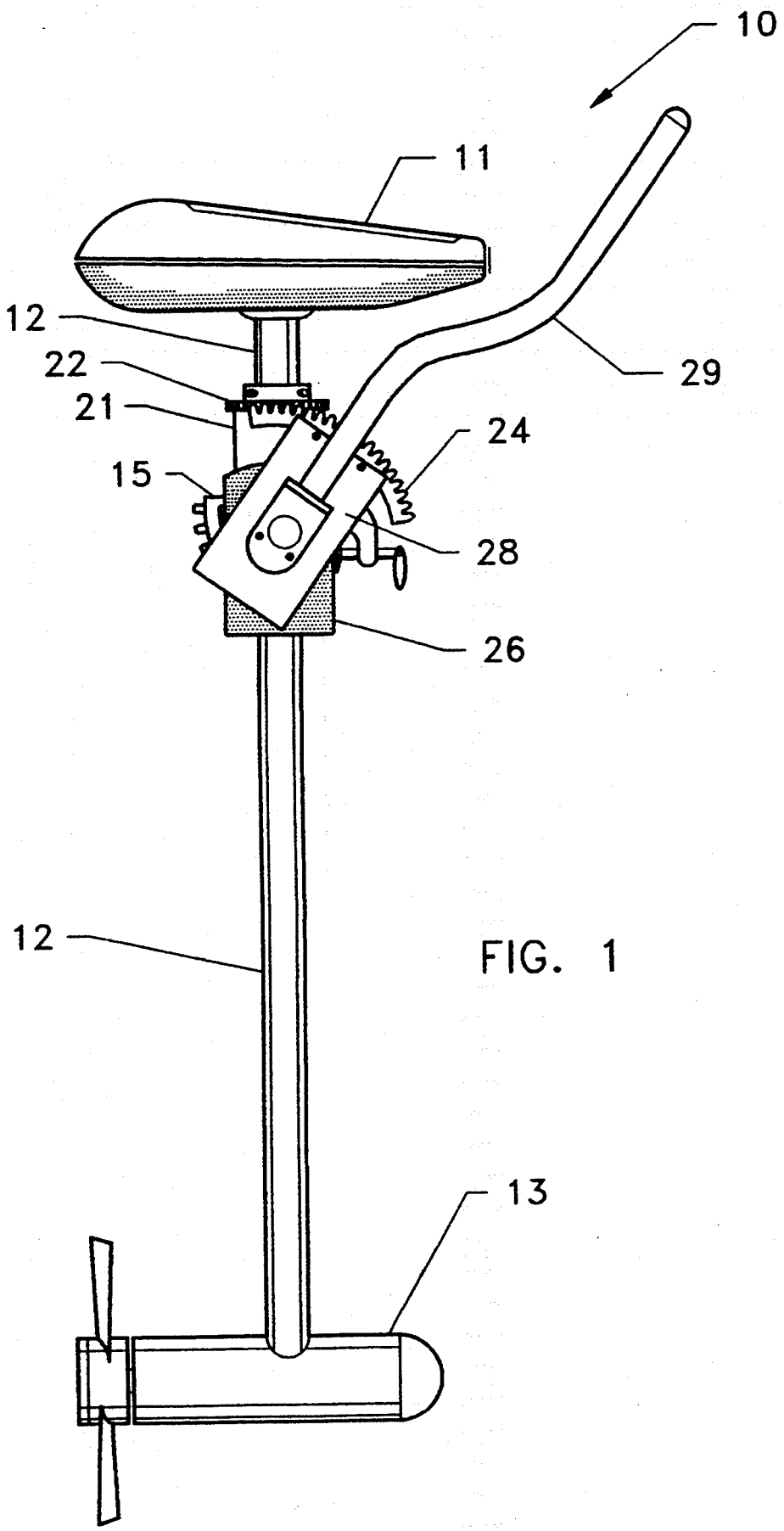
FIG. 1 is a side view showing the steering device mounted on a trolling motor using a vertical gear mechanism and vertical tiller.

Referring now to FIG. 1, the electric trolling motor steering device, designated generally by the reference numeral 10, is shown with its major components. The electric trolling motor is a conventional commercially available motor having a control head 11, steering shaft 12, a motor mount 15, and power unit 13. The steering device 10 comprises a two-part mounting block 21, a split ring gear 22 clamped to motor shaft 12, a sector gear 24, a two-position tiller bracket 26, a sector gear bracket 28, and a tiller 29. Movement of the tiller handle through a vertical arc moves the sector gear which in turn drives the ring gear clamped to the trolling motor shaft.

Figure 2:
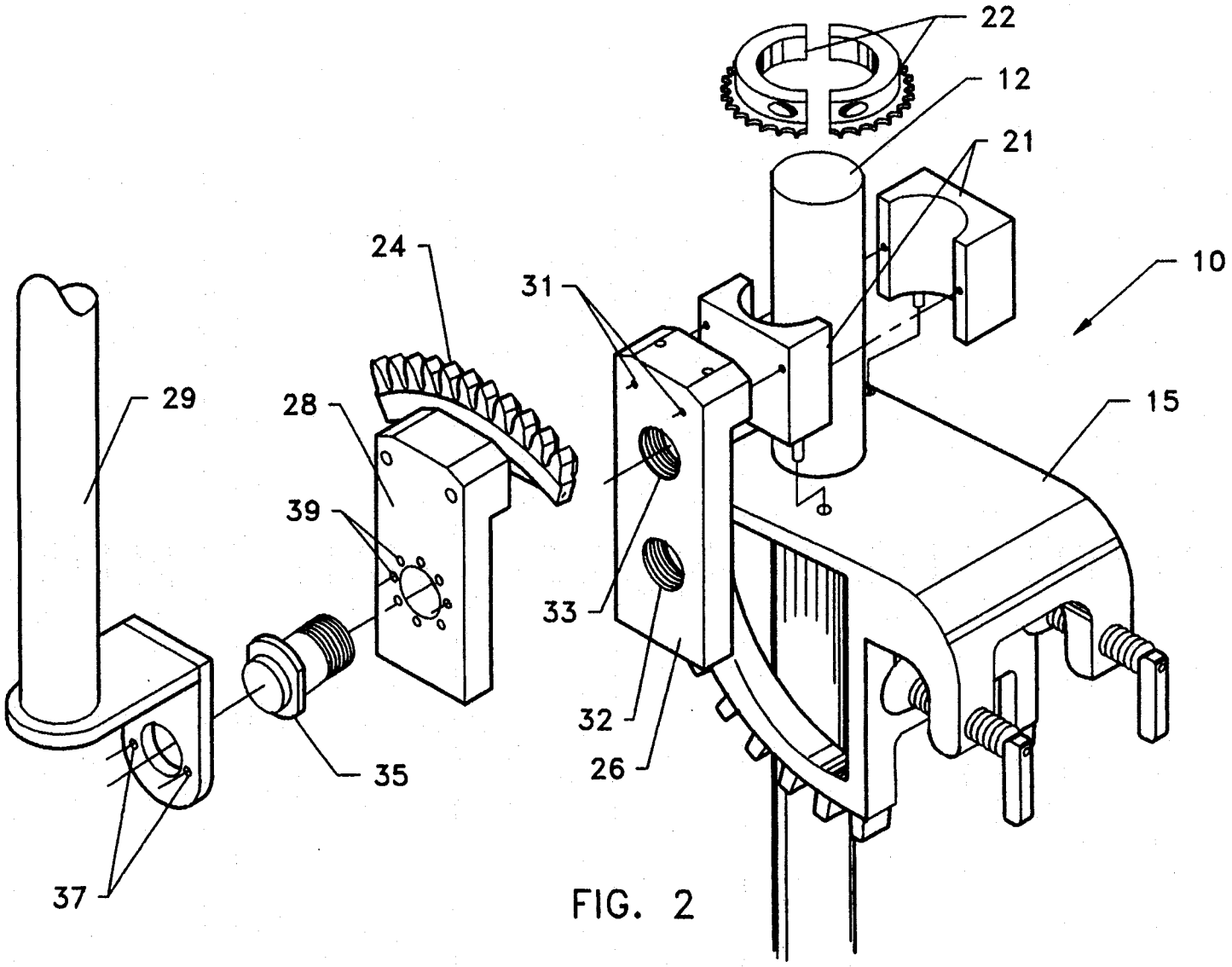
FIG. 2 is a perspective view of the steering device showing a vertical sector gear with a vertical tiller.

The structure of the steering device may be seen more clearly in FIG. 2. Split ring gear 22 clamps to steering shaft 12 using countersunk machine screws. Mounting block 21 also is a two-part device held together by machine screws but attaches to a fixed part of the trolling motor mount 15. The split ring gear moves with the steering shaft while the mounting block remains fixed with the motor mount 15. Tiller bracket 26 is fixed to mounting block 21 using machine screws.

The tiller bracket has holes 31 for attachment to block 21 in the vertical position as shown. Tiller bracket 26 also has a first aperture 32 and second aperture 33 for rotatably engaging the tiller pivot shaft 35. Sector gear bracket 28 also has a single aperture for rotatably engaging tiller pivot shaft 35 as shown. During operation of the tiller 29, sector gear bracket 28 is secured to the tiller so that both the tiller and the sector gear bracket will rotate together by spring-load pins 37 which engage the sector gear bracket 28 at adjustment holes 39. By retracting pins 37, the tiller 29 may be repositioned with respect to the sector gear bracket, thereby adjusting the position of the tiller. Sector gear 24 is fixed to sector gear bracket 28.

Figure 3:
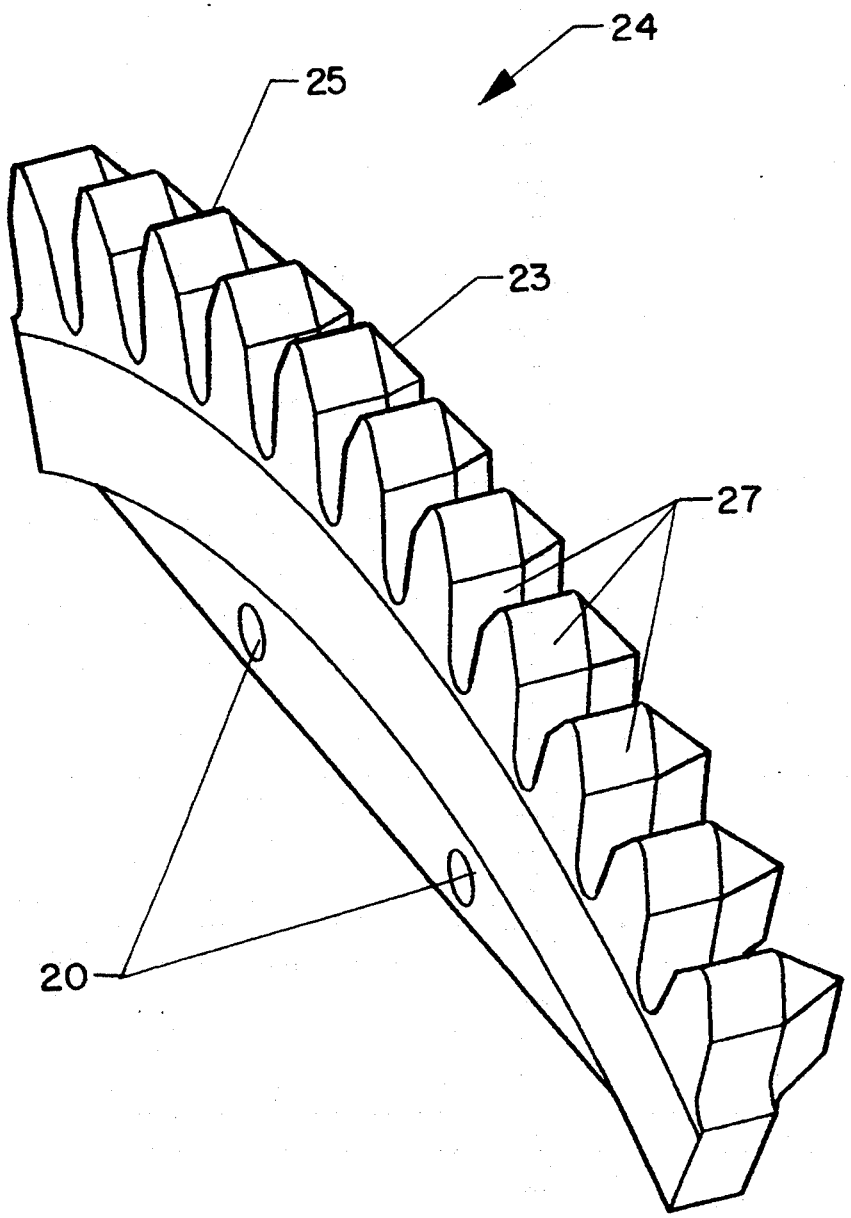
FIG. 3 is a perspective view of the machined two-position sector gear.

Sector gear 24, shown as a machined gear in FIG. 3, has a novel tooth configuration allowing gear engagement in both the rotating plane of the sector gear, that is, edge to edge with the driven gear, or in a plane perpendicular to the sector gear, that is, a 90° engagement. The two-plane engagement capacity of the sector gear 24 is provided by the shaping of gear teeth 27 so that dual beveled meshing surfaces are provided, both on the gear edge 25 and on the gear face 23. Sector gear 24 is also provided with bore holes 20 for use in attaching the sector gear to the rotatable sector gear bracket 28 (shown in FIGS. 1 and 2). These features allow both horizontal and vertical operation of the tiller.

Figure 4:
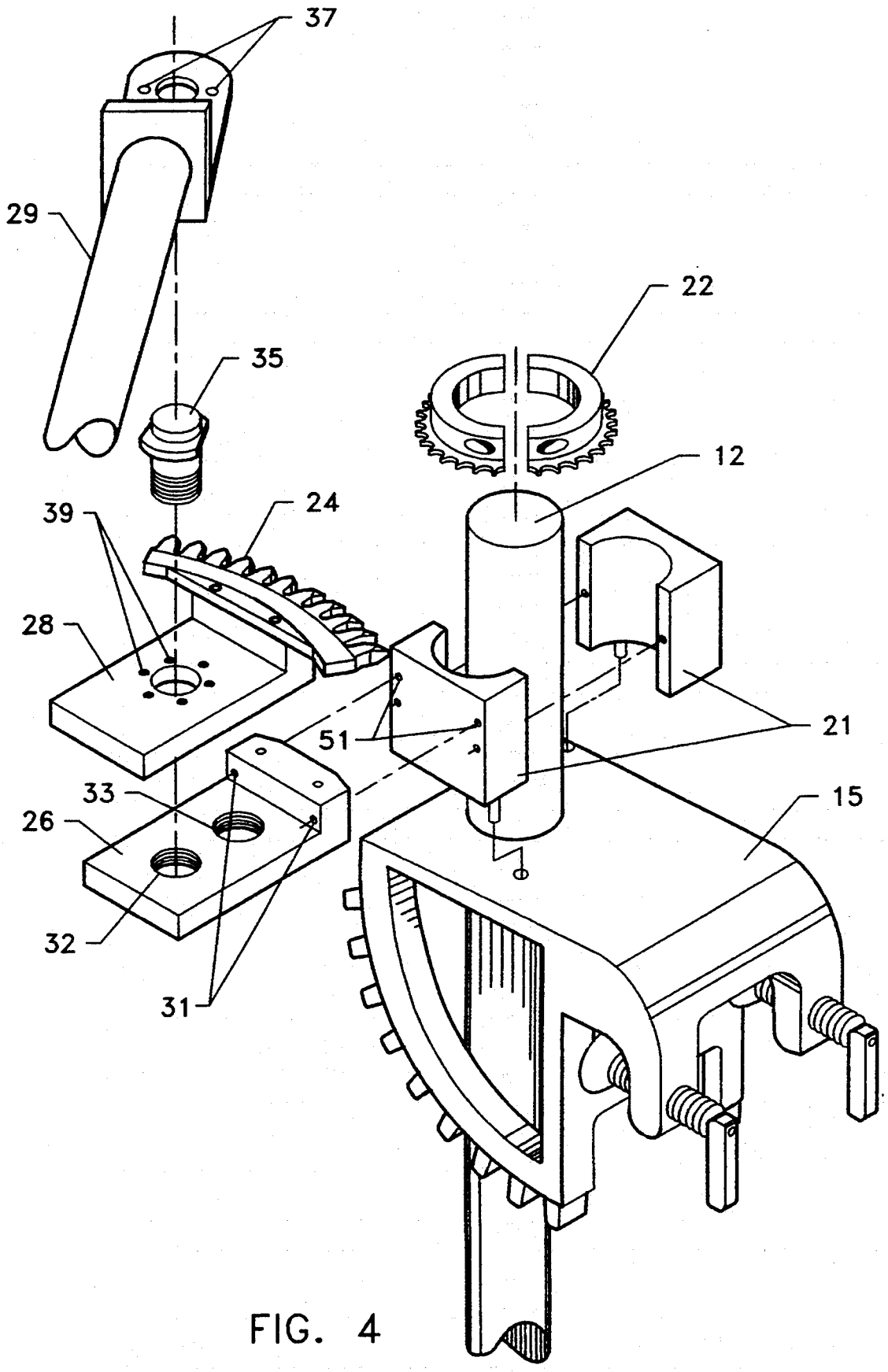
FIG. 4 is an exploded perspective view of the steering device configured for horizontal gearing and tiller movement.

FIG. 4 depicts the steering device rotated to use a horizontal gearing and horizontal tiller arrangement. Split ring gear 22 and mounting block 21 remain affixed to the shaft 12 and motor mount 15, respectively. The tiller bracket 26 and sector gear bracket 24 are rotated and re-attached in the horizontal position as shown using machine screws through holes 31 into threaded holes 51. Likewise, the sector gear bracket 28 is rotated and the tiller 29 is re-attached using tiller pivot shaft 35 through tiller pivot hole 32. The tiller now operates in a horizontal position as does the sector gear. Additionally, tiller 29 can be re-positioned with respect to sector gear 24 by releasing spring-loaded pins 37 which engage holes 39 and repositioning the tiller.

Figure 5:
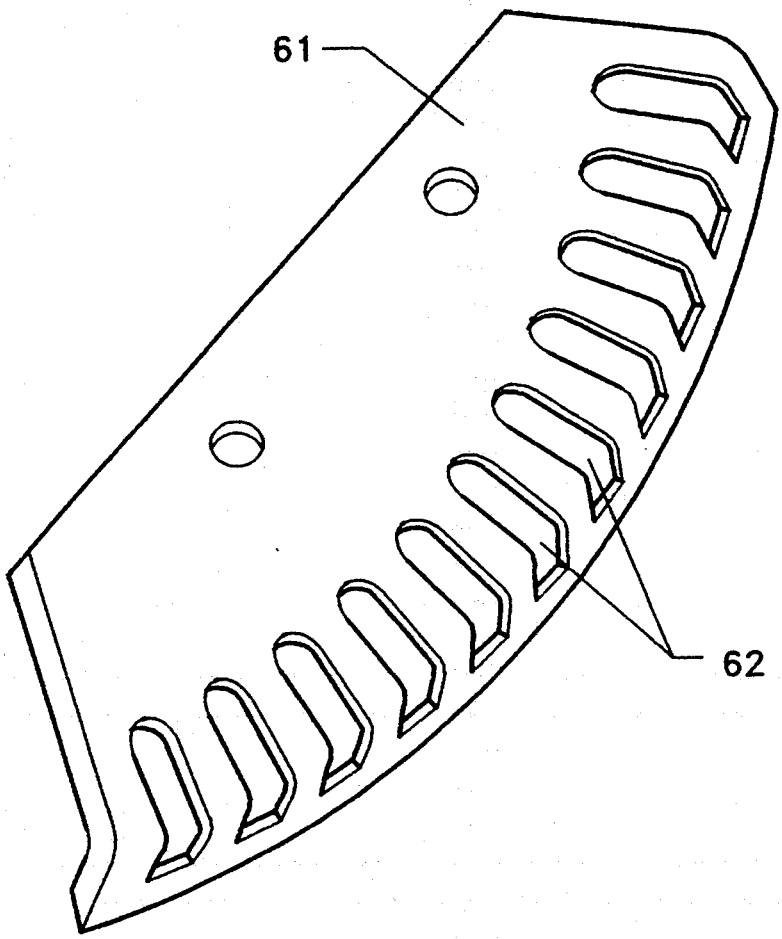
FIG. 5 is a stamped sheet metal sector gear which is the alternate to the machined sector gear.

FIG. 5 depicts an alternate embodiment of the machined sector gear 24 wherein a sheet metal sector 61 is used as a substitute. The sheet metal sector 61 has "L" shaped slots 62 which provide a dual engagement surface for mating with split ring gear 22. The sheet metal sector 61 is also positionable in both the horizontal and vertical plane of rotation.

Figure 6:
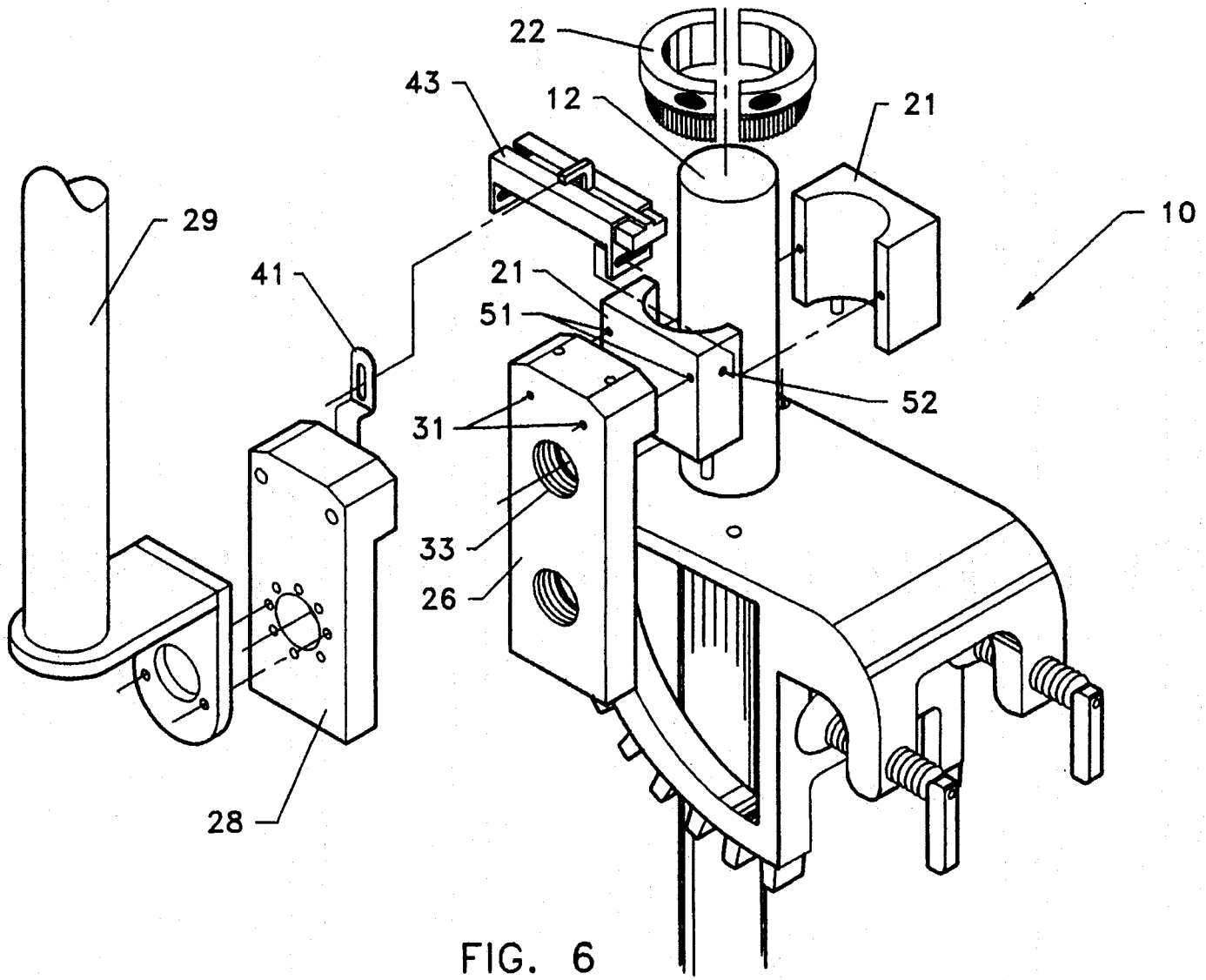
FIG. 6 is a perspective view of the two-position geared tiller mechanism using rack and pinion gearing as an alternate embodiment.

Referring now to FIG. 6, the steering device 10 is shown in an exploded view in an alternate embodiment with a vertical tiller installation. The split ring gear 22 and the mounting block 21 remain attached as for the horizontal tiller mode. The tiller bracket 26 is removed and rotated (original upward side facing the motor shaft) and re-attached in the vertical position as shown using machine screws through holes 31 into threaded holes 51. Likewise, the sector gear bracket 28 is rotated (original upward facing the motor shaft) and the tiller 29 is re-attached through tiller pivot hole 33. In this variant, a slotted bracket 41 replaces the original machined sector gear and allows the tiller to operate a rack gear 43. The rack gear 43 drives split ring gear 22 thereby rotating the trolling motor shaft 12 as in the previous configuration. The rack is attached to block 21 using machine screws in holes 52. As in the case of the machined sector gear, the rack and ring gear mechanism may be positioned with the tiller 29 in either the vertical or horizontal operating positions.

Figure 7:
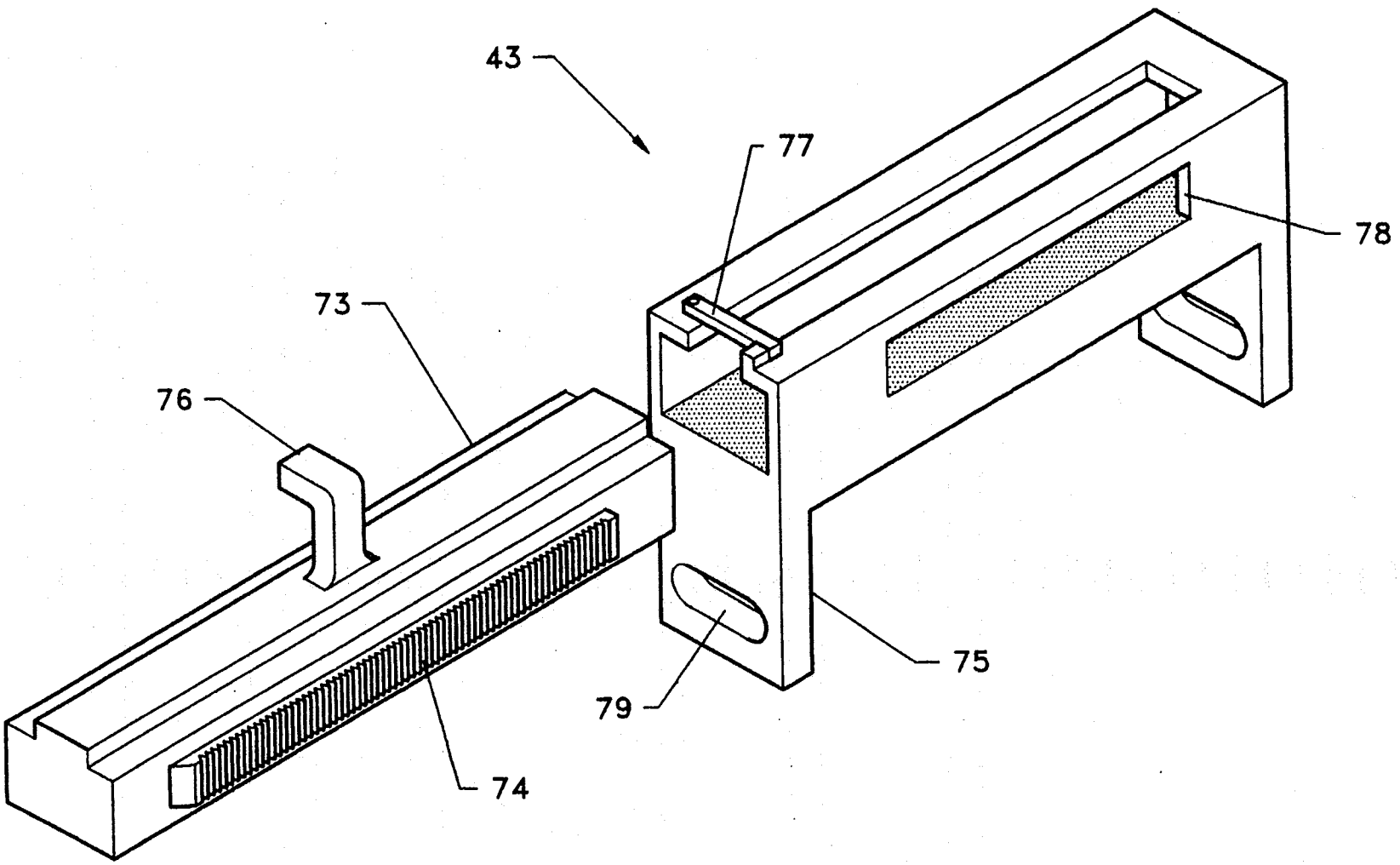
FIG. 7 is a perspective view of a rack gear used as an alternative to the sector drive gear.

With reference to FIG. 7, the details of the rack gear 43 are depicted. A slider 73 having gear teeth 74 and an "L"-shaped engagement pin 76 is located in rack housing 75. A spring loaded latch 77 allows the slider to be slid into the housing but prevents the slider from leaving the housing during steering operations. The slider gear teeth 74 engage the split ring gear through housing slot 78. The entire assembly is attached using machine screws through slots 79 to the two-part mounting block 21 as shown in FIG. 6.

Figure 8:
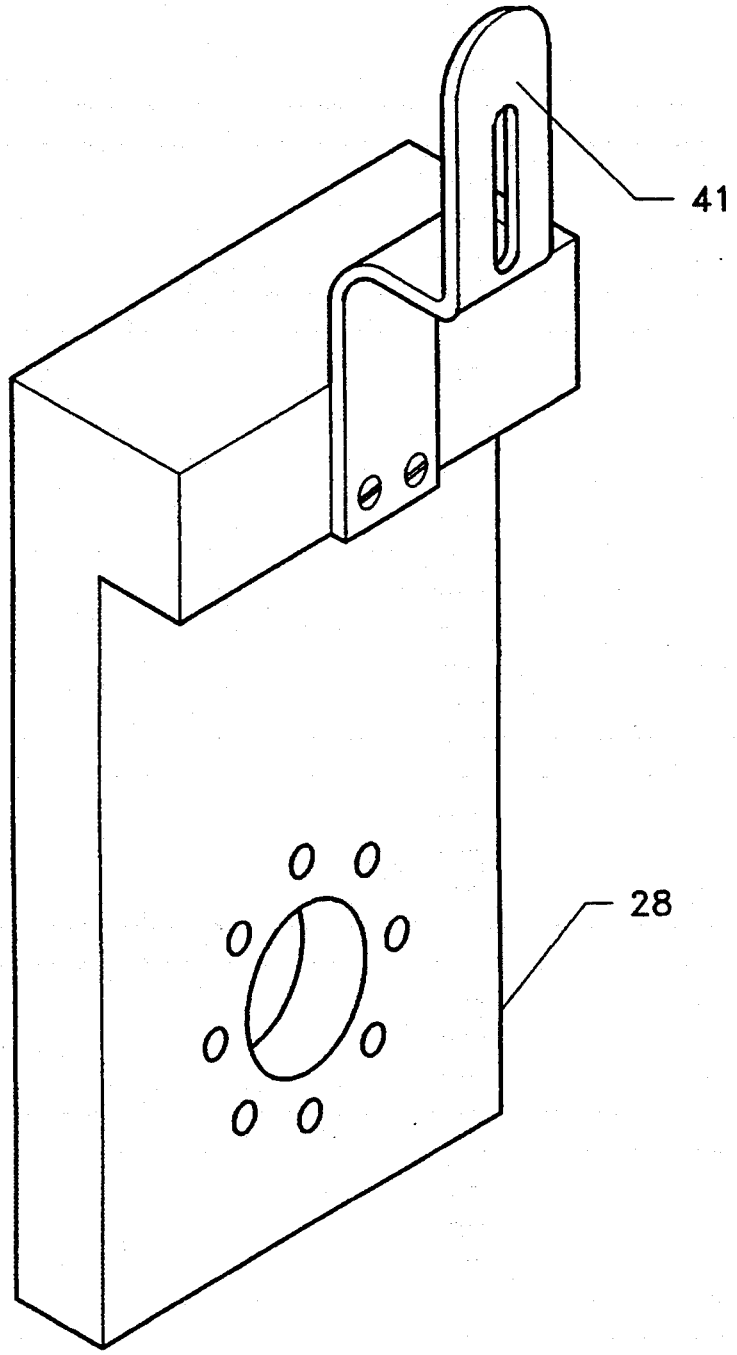
FIG. 8 is a perspective view of the sector gear bracket using the slotted bracket to replace the sector gear.

FIG. 8 shows the slotted bracket 41 attached to sector gear bracket 28. The slotted bracket 41 replaces the mechanical sector gear 24 for installation of the two position tiller with the rack gear mechanism. This bracket is also used for the installation of the two-position as a modification to existing trolling motors having chain and sprocket steering mechanism. By re-positioning the tiller and bracket assemblies in the same manner as with the sector gear arrangement, the pin adapter 41 will engage the L-shaped pin 76 for either tiller operation in the horizontal plane or the vertical plane.

Figure 9:
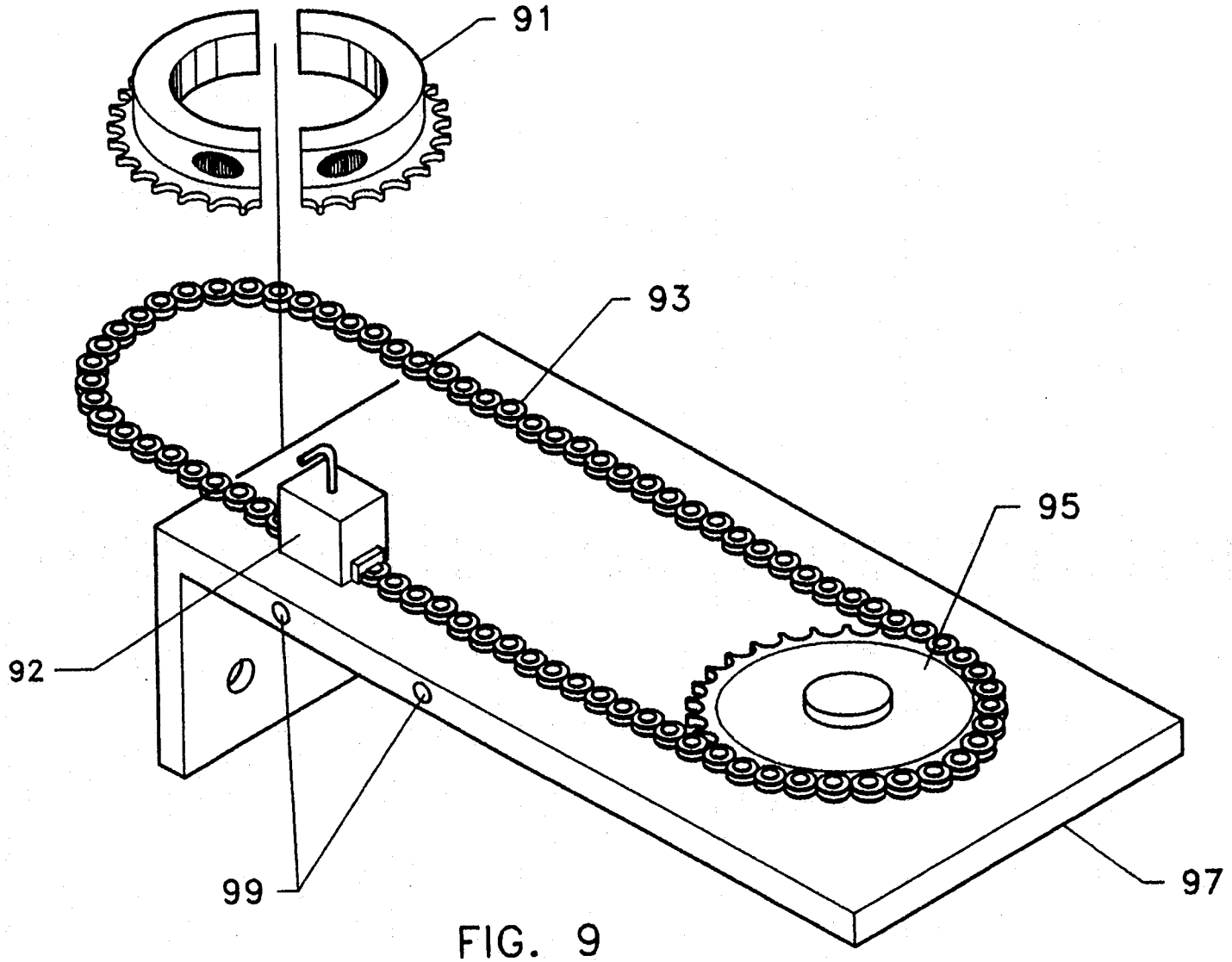
FIG. 9 is an alternate embodiment adapting the steering device to a typical conventional sprocket and chain steering mechanism.

Another variant may be seen by reference to FIG. 9. Several existing trolling motors have a chain and sprocket assembly within the trolling motor control. This embodiment provides an adaptation of the two-plane tiller mechanism to an existing motor. The embodiment includes a split-ring sprocket gear 91 which clamps to the trolling motor shaft as before. Sprocket gear 91 is driven by the chain 93 which is further routed around idler sprocket 95. Sprocket bracket 97 provides a support for the idler sprocket and an attachment point for the tiller mechanism using the slotted bracket 41 (shown in FIG. 8) attached to sector gear bracket 28. By assembling the tiller bracket 26 in the horizontal position, the tiller can operate a chain and pin drive arrangement with the tiller rotating in the horizontal plane by engaging clamping block 92. With the brackets in the vertical position, the tiller rotates in the vertical position. Attachment of the tiller bracket 26 is by machine screws to holes 99 in an identical configuration as disclosed in previous figures.

Figure 10:
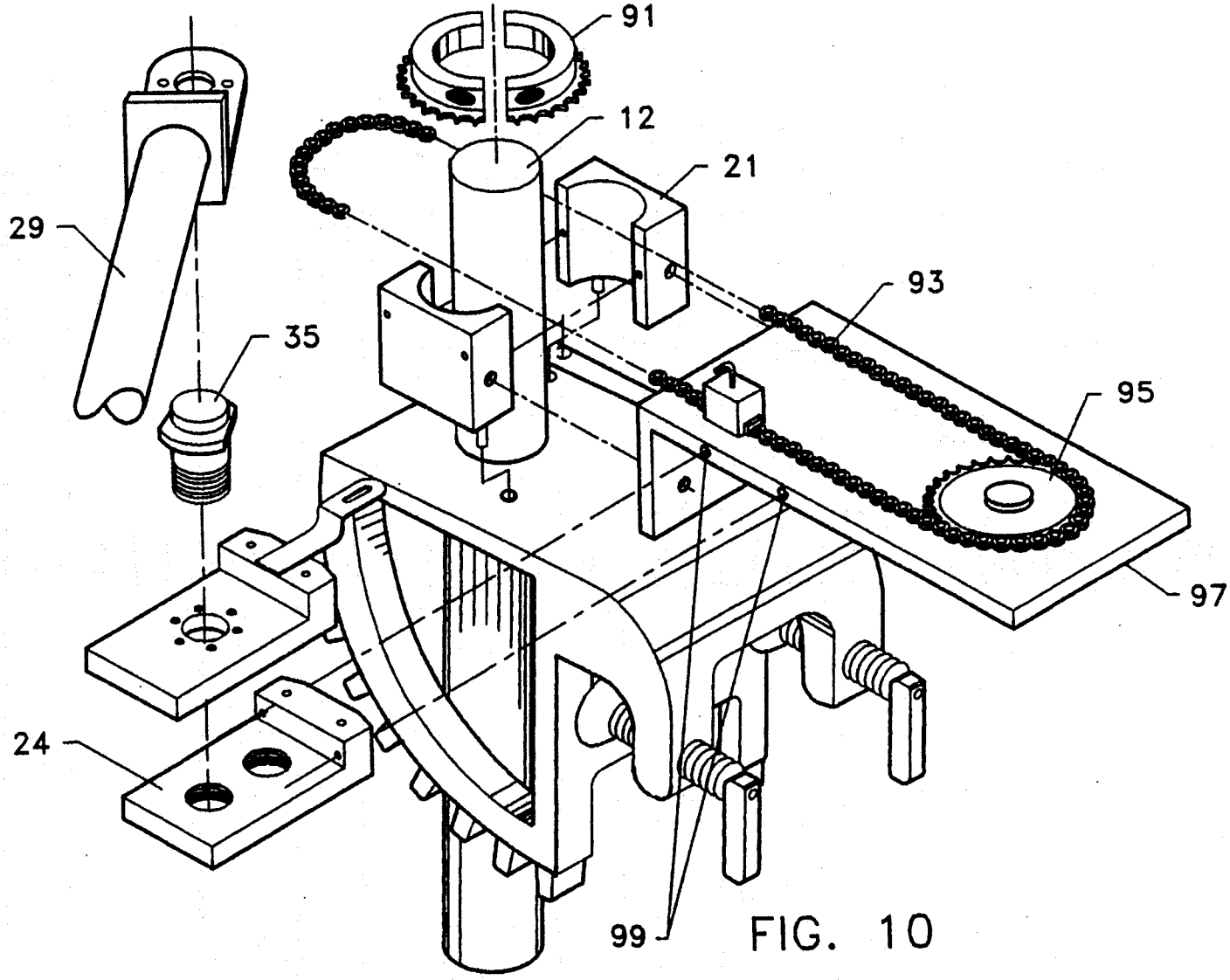
FIG. 10 is an exploded perspective view of the steering device using the horizontal tiller adapted to a chain and sprocket steering system.

The sprocket-chain embodiment can be seen as installed in FIG. 10. Bracket 97 supports sprocket 95 and is attached by machine screws to mounting block 21. The split sprocket clamps to the steering shaft 12 as in the previous embodiments. The tiller bracket 24 is mounted on the side of the sprocket bracket 97 using threaded holes 99. Tiller 29 can be installed in the horizontal position as shown or in the vertical position as in the other embodiment.

The novel features and benefits of the present invention are numerous. The steering mechanism can be installed to provide either horizontal or vertical geared tiller movement. This feature allows installation in different boats or boat/motor arrangements, allows different configurations to be made easily when transferring the device from one boat to another. It eliminates the need for foot pedals. It also can easily be adapted to existing motors having a variety of original steering mechanisms.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A steering device for an electric trolling motor comprising:

means for rotating an electric trolling motor shaft;

means for engaging said means for rotating; and a two-position tiller bracket having a handle and attached to said means for engaging for said two-position tiller handle having a two-position mounting for rotation in the vertical plane in a first mounting position and in a horizontal plane in a second mounting position.

2. A steering device for an electric trolling motor as in claim 1 wherein said means for rotating an electric trolling motor shaft comprises a split ring gear having a clamping means to secure said split ring gear to the trolling motor shaft.

3. A steering device for an electric trolling motor as in claim 1 wherein said means for engaging comprises a two-part mounting block secured together with machine screws, said block comprising two half blocks.

4. A steering device for an electric trolling motor as in claim 3 wherein said means for engaging comprises a two-part block attached to a fixed part of an electric trolling motor.

5. A steering device for an electric trolling motor as in claim 4 wherein said means for engaging comprises a two-position tiller bracket having a first and second aperture providing a tiller pivot.

6. A steering device for an electric trolling motor as in claim 5 wherein said means for engaging comprises a sector gear bracket rotatably mounted on said two-position tiller bracket.

7. A steering device for an electric trolling motor as in claim 6 wherein said means for engaging comprises a sector gear fixedly attached to said sector gear bracket and meshing with said means for rotating all electric trolling motor.

8. A steering device for an electric trolling motor as in claim 1 wherein said means for engaging further comprises a rack gear slidably-mounted to a slider bracket which in turn is mounted to the electric trolling motor, said rack gear engaging said means for rotating the electric trolling motor.

9. A steering device for an electric trolling motor comprising:

a split ring gear having a clamping means for attaching to an electric trolling motor shaft;

a two-position sector gear having a means for attaching to the electric trolling motor and engaging said split ring gear in the vertical plane in a first mounting position and in a horizontal plane in a second mounting position; and a two-position tiller handle attached to said two-position sector gear.

10. A steering device for an electric trolling motor comprising:

a two-part mounting block for attachment to a fixed part of an electric trolling motor;

a sprocket bracket attached to said two-part mounting block;

an idler sprocket bracket;

a split-ring sprocket gear clamped to an electric motor steering shaft;

a chain engaging both said idler sprocket and said split-ring sprocket gear;

a clamping block attached to said chain and having an "L"-shaped pin affixed to said clamping block;

a two-position tiller bracket attached to said sprocket bracket;

a sector gear bracket rotatably attached to said two-position tiller bracket;

a slotted bracket for engaging said "L" shaped pin, said slotted bracket attached to said sector gear bracket; and a tiller attached to said sector gear bracket.

11. A steering device for an electric trolling motor comprising:

a two-part mounting block for attachment to a fixed part of an electric trolling motor;

a two-position tiller bracket attached to said two-part mounting block;

a sector bracket rotatably attached to said two-part mounting block;

a dual-beveled sector gear attached to said sector gear bracket; and a tiller attached to said sector gear bracket.

* * * * *